US005450834A

United States Patent [19]

Yamanaka et al.

[11] Patent Number: 5,450,834

[45] Date of Patent: Sep. 19, 1995

[54] EVAPORATIVE FUEL-PROCESSING SYSTEM FOR INTERNAL COMBUSTION ENGINES

[75] Inventors: Masayoshi Yamanaka; Kazutomo Sawamura; Hiroshi Maruyama; Kenichi Maeda, all of Wako, Japan

[73] Assignee: Honda Giken Kogyo Kabushiki Kaisha, Tokyo, Japan

[21] Appl. No.: 212,572

[22] Filed: Mar. 16, 1994

[30] Foreign Application Priority Data

Jun. 7, 1993 [JP] Japan ..... 5-163207

[51] Int. Cl.[6] ..... F02M 25/08; F02M 33/02

[52] U.S. Cl. ..... 123/520; 123/198 D

[58] Field of Search ..... 123/516, 518, 519, 520, 123/198 D

[56] References Cited

U.S. PATENT DOCUMENTS 5,146,902 9/1992 Cook et al. ..... 123/520
5,261,379 11/1993 Lipinski et al. ..... 123/520
5,297,529 3/1994 Cook et al. ..... 123/520
5,299,545 4/1994 Kuroda et al. ..... 123/520
5,327,873 7/1994 Ohuchi et al. ..... 123/198 D
5,333,590 8/1994 Thomson ..... 123/520

*Primary Examiner*—Thomas N. Moulis
*Attorney, Agent, or Firm*—Nikaido, Marmelstein, Murray & Oram

[57] ABSTRACT

An evaporative fuel-processing system for an internal combustion engine includes an evaporative emission control system having a fuel tank, a canister, a passage extending from the canister to an intake passage of the engine, and a purge control valve arranged across the passage, and a pressurization device for pressurizing the interior of the evaporative emission control system. An ECU actuates the pressurization device to bring the evaporative emission control system into a positively pressurized state, after the purge control valve and an open-to-atmosphere control valve arranged across a passage connected to the canister are closed, and detects an amount of evaporative fuel generated in the fuel tank. The ECU determines whether or not a leakage occurs from the evaporative emission control system, based on a rate of variation in pressure within the evaporative emission control system, and a reference value which is determined based on the amount of evaporative fuel detected.

3 Claims, 9 Drawing Sheets

EVAPORATIVE FUEL-PROCESSING SYSTEM FOR INTERNAL COMBUSTION ENGINES

BACKGROUND OF THE INVENTION

1. Field of the Invention

This invention relates to an evaporative fuel-processing system for internal combustion engines, which performs an abnormality diagnosis of an evaporative emission control system of the engine for purging evaporative fuel generated in the fuel tank into the intake system.

2. Prior Art

Conventionally, there has been widely used an evaporative fuel-processing system for internal combustion engines, which comprises a fuel tank, a canister for adsorbing evaporative fuel generated in the fuel tank, and a purge control valve arranged across a passage extending from the canister to the intake pipe of the engine, for controlling purging of the evaporative fuel into the intake pipe.

An evaporative fuel-processing system of this kind has been proposed by U.S. Pat. No. 5,146,902, which has a function of performing a leakage diagnosis of an evaporative emission control system of the engine, by pressurizing the interior of the fuel tank by charging air thereinto by means of an air pump, detecting a rate of variation in the pressure within the fuel tank occurring after the pressurization, and determining that a leak has occurred from the evaporative emission control system when the rate of variation is large.

However, according to the above proposed leakage diagnosis method, there is a fear that a misjudgment is made depending on the condition of generation of evaporative fuel within the fuel tank. More specifically, when the interior of the fuel tank is pressurized to detect the rate of variation in the pressure within the fuel tank, in a condition where the ambient temperature is so high as cause generation of a large amount of evaporative fuel from the fuel tank, the tank internal pressure has already increased due to the generation of a large amount of evaporative fuel. As a result, the rate of variation in the pressure does not become large even if a leak has occurred, whereby a misjudgment can be made that the evaporative fuel emission control system is in a normal state.

SUMMARY OF THE INVENTION

It is the object of the invention to provide an evaporative fuel-processing system for an internal combustion engine, which is capable of performing a leakage diagnosis of an evaporative fuel emission control system, with improved accuracy.

To attain the above object, the present invention provides an evaporative fuel-processing system for an internal combustion engine having an intake passage, comprising:

an evaporative emission control system having a fuel tank, a canister for adsorbing evaporative fuel generated within the fuel tank, a first passage connected to the canister for opening an interior of the canister into the atmosphere, a second passage extending from the canister to the intake passage, and a purge control valve arranged across the second passage;

pressurization means for pressurizing an interior of the evaporative emission control system;

pressure-detecting means for detecting pressure within the evaporative emission control system;

an open-to-atmosphere control valve arranged across the first passage;

positive pressure-setting means for closing the purge control valve and the open-to-atmosphere control valve, and for actuating the pressurization means to bring the evaporative emission control system into a positively pressurized state, after the purge control valve and the open-to-atmosphere control valve are closed;

evaporative fuel amount-detecting means for detecting an amount of evaporative fuel generated in the fuel tank; and abnormality-determining means for determining whether there is a leakage from the evaporative emission control system, based on a rate of variation in the pressure within the evaporative emission control system detected by the pressure-detecting means after the evaporative emission control system is brought into the positively pressurized state, and a reference value determined based on the amount of evaporative fuel detected by the evaporative fuel amount-detecting means.

Preferably, the evaporative fuel-processing system includes abnormality determination-inhibiting means for inhibiting operation of the abnormality determining means when the amount of evaporative fuel detected by the evaporative fuel amount-detecting means is larger than a predetermined value.

Also preferably, the evaporative fuel-processing system includes a third passage connecting between the fuel tank and the canister, shut-off valve means arranged across the third valve, open-to-atmosphere means for opening the interior of the evaporative emission control system into the atmosphere by opening the purge control valve, the open-to-atmosphere control valve, and the shut-off valve means, and closure means for closing the fuel tank by closing the open-to-atmosphere control valve and the shut-off valve means after the interior of the evaporative emission control system is opened into the atmosphere, the pressure-detecting means being for detecting pressure within the fuel tank, and wherein the evaporative fuel amount-detecting means detects the amount of fuel generated in the fuel tank, from a rate of variation in the pressure within the fuel tank detected by the pressure-detecting means after the fuel tank is closed.

More preferably, the evaporative fuel-processing system includes correcting means for correcting the rate of variation in the pressure within the evaporative emission control system detected by the pressure-detecting means after the evaporative emission control system is brought into the positively pressurized state, based on the amount of evaporative fuel detected by the evaporative fuel amount-detecting means, and wherein the abnormality-determining means determines that there is a leakage from the evaporative emission control system when the corrected rate of variation in the pressure is larger than a reference value.

The above and other objects, features, and advantages of the invention will be more apparent from the following detailed description taken in conjunction with the accompanying drawings.

DETAILED DESCRIPTION

The invention will now be described in detail with reference to the drawings showing an embodiment thereof.

Figure 1:
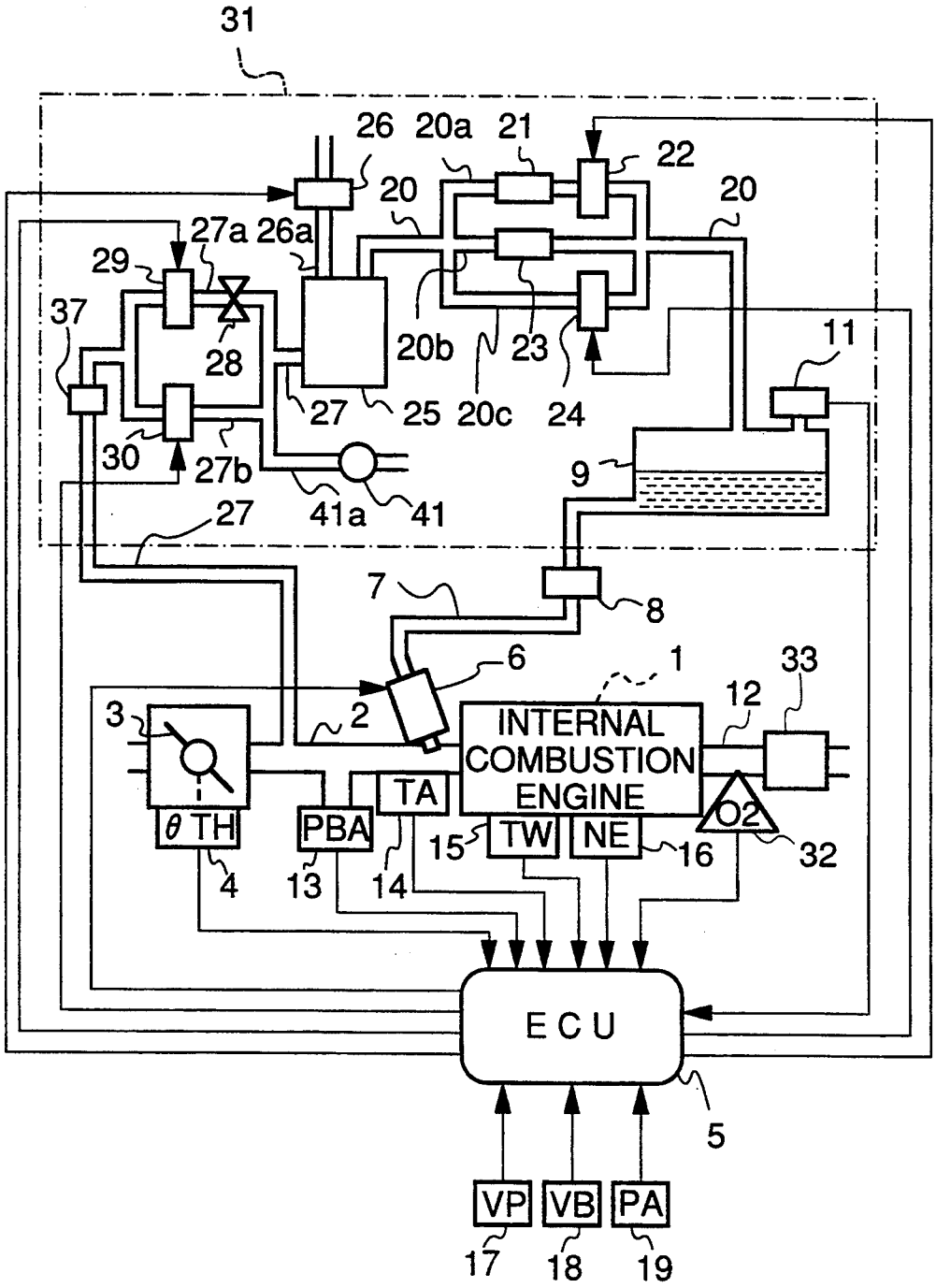
FIG. 1 is a block diagram showing the whole arrangement of an internal combustion engine and an evaporative fuel-processing system therefor, according to an embodiment of the invention.

Referring first to FIG. 1, there is illustrated the whole arrangement of an internal combustion engine and an evaporative fuel-processing system therefor, according to an embodiment of the invention.

In the figure, reference numeral 1 designates an internal combustion engine (hereinafter simply referred to as "the engine") having four cylinders, not shown, for instance. Connected to the cylinder block of the engine 1 is an intake pipe 2 across which is arranged a throttle valve 3. A throttle valve opening ($\theta$TH) sensor 4 is connected to the throttle valve 3 for generating an electric signal indicative of the sensed throttle valve opening and supplying the same to an electronic control unit (hereinafter referred to as "the ECU") 5.

Fuel injection valves 6, only one of which is shown, are inserted into the interior of the intake pipe 2 at locations intermediate between the cylinder 15 block of the engine 1 and the throttle valve 3 and slightly upstream of respective intake valves, not shown. The fuel injection valves 6 are connected to a fuel tank 9 via a fuel supply pipe 7, and a fuel pump 8 is arranged across the fuel supply pipe 7. The fuel injection valves 6 are electrically connected to the ECU 5 to have their valve opening periods controlled by signals therefrom.

An intake pipe absolute pressure (PBA) sensor 13 and an intake air temperature (TA) sensor 14 are inserted into the intake pipe 2 at locations downstream of the throttle valve 3. The PBA sensor 13 detects absolute pressure PBA within the intake pipe 2, and the TA sensor 14 detects temperature TA of intake air, for supplying electric signals indicative of the sensed values to the ECU 5.

An engine coolant temperature (TW) sensor 15 formed of a thermistor or the like is inserted into a coolant passage formed in the cylinder block, which is filled with a coolant, for supplying an electric signal indicative of the sensed engine coolant temperature TW to the ECU 5.

An engine rotational speed (NE) sensor 16 is arranged in facing relation to a camshaft or a crankshaft of the engine 1, neither of which is shown. The NE sensor 16 generates a signal pulse as a TDC signal pulse at each of predetermined crank angles whenever the crankshaft rotates through 180 degrees, the pulse being supplied to the ECU 5.

Arranged across an exhaust pipe 12 is an O2 sensor 32 as an exhaust gas component concentration sensor for detecting the concentration VO2 of oxygen present in exhaust gases, and generating a signal indicative of the sensed oxygen concentration VO2 to the ECU 5. Further, a three-way catalyst 33 is arranged in the exhaust pipe 12 at a location downstream of the O2 sensor 32, for purifying exhaust gases in the exhaust pipe 12.

Further connected to the ECU 5 are an automotive vehicle speed sensor 17 for detecting the traveling speed VP of an automotive vehicle on which the engine 1 is installed, a battery voltage sensor 18 for detecting output voltage VB from a battery, not shown, of the engine, and an atmospheric pressure sensor 19 for detecting atmospheric pressure PA, of which output signals indicative of the sensed values are supplied to the ECU 5.

Next, an evaporative emission control system 31 will be described, which comprises the fuel tank 9, a charging passage 20, a canister 25, a purging passage 27, etc.

The fuel tank 9 is provided with a tank internal pressure (PT) sensor 11 for detecting pressure PT within the fuel tank 9, of which an output signal indicative of the sensed pressure PT is supplied to the ECU 5.

The fuel tank 9 is connected to the canister 25 via the charging passage 20 which comprises first to third branches **20*a* to 20*c*. The first branch 20*a* is provided with a one-way valve 21 and a puff loss valve 22. The one-way valve 21 is constructed such that it opens only when the tank internal pressure PT is higher than atmospheric pressure by approximately 12 to 13 mmHg. The puff loss valve 22 is an electromagnetic valve, which is opened during purging of evaporative fuel, described hereinafter, and is closed while the engine is in stoppage. The operation of the valve 22 is controlled by a signal supplied from the ECU 5**.

The second branch **20*b* is provided with a two-way valve 23, which is constructed such that it opens when the tank internal pressure PT is higher than atmospheric pressure by approximately 20 mmHg and the tank internal pressure PT is lower than pressure on one side of the two-way valve 23 close to the canister 25** by a predetermined value.

The third branch **20*c* is provided with a bypass valve 24, which is an electromagnetic valve and which is normally closed, and opened and closed during execution of abnormality determination, described hereinafter, by a signal from the ECU 5**.

The canister 25 contains activated carbon for adsorbing evaporative fuel, and has an air inlet port, not shown, via a passage **26*a*. Arranged across the passage 26*a* is a drain shut valve 26, which is a normally-open type electromagnetic valve, and is temporarily closed during execution of the abnormality determination, by a signal from the ECU 5**.

The canister 25 is connected via the purging passage 27 to the intake pipe 2 at a location downstream of the throttle valve 3. The purging passage 27 comprises first and second branches **27*a* and 27*b*. The first branch 27*a* is provided with a jet orifice 28 and a jet purge control valve 29, and the second branch 27*b* is provided with a purge control valve 30. The jet purge control valve 29 is an electromagnetic valve for controlling an amount of an air-fuel mixture to be purged, within a range which is so small as cannot be controlled by the purge control valve 30. The purge control valve 30 is an electromagnetic valve which is constructed such that the flow rate of the mixture can be continuously controlled by changing the on/off duty ratio of a control signal therefor. These electromagnetic valves 29 and 30 are controlled by the ECU 5**.

Further, a pressurization device 41 has an air blow-off pipe 41*a* connected to the second branch 27*b*. The pressurization device 41, which is formed by an air pump or the like, positively pressurizes the interior of the fuel tank 9 by blowing air into the fuel tank 9 during positive pressurization in the process of executing abnormality determination, described hereinafter. A hot wire-type flowmeter 37 is provided in the purging passage 27 at a location downstream of a junction of the branches 27*a* and 27*b*.

The ECU 5 comprises an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU"), memory means storing programs executed by the CPU and for storing results of calculations therefrom, etc., and an output circuit which outputs driving signals to the fuel injection valves 6, puff loss valve 22, bypass valve 24, jet purge control valve 29, and purge control valve 30.

The CPU 5b operates in response to the above-mentioned various engine parameter signals from the various sensors to determine operating conditions in which the engine 1 is operating, such as a feedback control region where the air-fuel ratio is controlled in response to the detected oxygen concentration in the exhaust gases, and open-loop control regions, and calculates, based upon the determined engine operating conditions, a fuel injection period Tout over which the fuel injection valve 6 is to be opened, in synchronism with generation of TDC signal pulses, by the use of the following equation (1):

$$Tout = Ti \times K1 \times KO2 + K2 \quad (1)$$

where Ti represents a basic value of the fuel injection period Tout, which is read from a Ti map according to the engine rotational speed NE and the intake pipe absolute pressure PBA.

KO2 represents an air-fuel ratio correction coefficient which is determined based on the concentration of oxygen present in exhaust gases detected by the O2 sensor 32 when the engine 1 is operating in the air-fuel ratio feedback control region, while it is set to predetermined values corresponding to the respective operating regions of the engine when the engine 1 is in the open-loop control regions.

K1 and K2 represent other correction coefficients and correction variables, respectively, which are set according to engine operating parameters to such values as optimize engine operating characteristics, such as fuel consumption and engine accelerability.

Figures 2A, 2B, 2C, 2D, 2E, 2F:
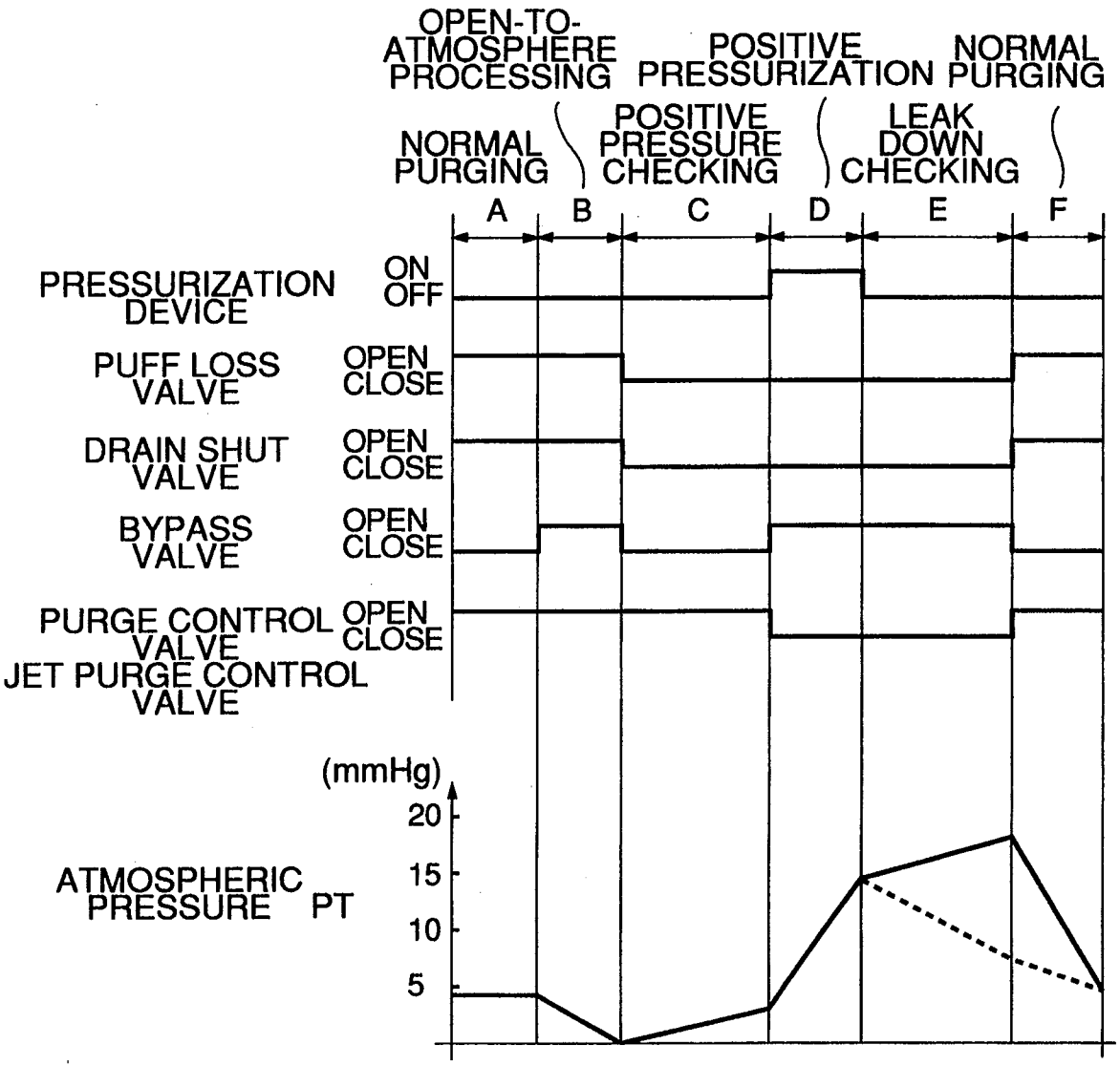
FIG. 2 is a timing chart showing operating patterns of valves arranged in the evaporative fuel-processing system, all appearing in FIG. 1, as well as changes in the tank internal pressure.

FIG. 2 shows operating patterns of the puff loss valve 22, bypass valve 24, drain shut valve 26, purge control valve 30, and jet purge control valve 29, and changes in the tank internal pressure PT occurring in response to operations of the valves. A manner of executing abnormality determination according to the present embodiment will be described with reference to FIG. 2. In the figure, the tank internal pressure PT is represented in terms of a differential pressure with respect to atmospheric pressure.

First, during normal operation (normal purging) of the engine, as indicated at a time period A in FIG. 2, the pressurization device 41 is deenergized, the puff loss valve 22, drain shut valve 26, purge control valve 30, and jet purge control valve 29 are opened, while the bypass valve 24 is closed. Then, evaporative fuel generated within the fuel tank 9 is allowed to flow through the charging passage 20 into the canister 20 to be temporarily stored therein. At the same time, fresh air is introduced through the passage 26*a* into the canister 25, and evaporative fuel flowing into the canister 25 is supplied together with the fresh air through the purging passage 27 to the intake pipe 2.

If preconditions (conditions for performing determination of abnormality), described hereinafter, are satisfied, the electromagnetic valves are operated as shown at time periods B to E in FIG. 2, to perform determination of abnormality.

First, the tank internal pressure PT is relieved into the atmosphere over the time period B in FIG. 2. More specifically, the puff loss valve 22, drain shut valve 26, jet purge control valve 29 and purge control valve 30 are held open, while the bypass valve 24 is opened, to thereby relieve the pressure within the fuel tank 9 into the atmosphere. Thus, the tank internal pressure PT, which has been equal to, for instance, +4 mmHg during the normal operation, decreases to 0 mmHg within the time period B.

Next, positive pressure checking is carried out over the time period C in FIG. 2. More specifically, the puff loss valve 22, bypass valve 24 and drain shut valve 26 are closed, and the other valves are held in the respective preceding states. With the valves thus set, the tank internal pressure PT increases, for example, by approximately 3 mmHg due to generation of evaporative fuel within the fuel tank, and then a rate of variation PVARIA in the tank internal pressure over the time period C is measured.

Next, positive pressurization is carried out over the time period D in FIG. 2. More specifically, the bypass valve 24 is opened, and the jet purge control valve 29 and purge control valve 30 are closed, with the other valves being held in the respective preceding states. With the valves thus set, the pressurization device 41, which has been off, is energized to positively pressurize the interior of the emission control system 31. This positive pressurization is carried out until the tank internal pressure PT increases up to a predetermined value PTHVL, e.g. +15 mmHg.

Then, leak down checking is carried out over the time period E in FIG. 2. More specifically, the pressurization device 41 is turned off, and the valves are held in the respective preceding states. Then, a pressure value PEND within the fuel tank is measured, which represents a value assumed at a time point after a predetermined time period tPT4 elapsed from a time point the PT value reached the predetermined value PTHVL, whereby a second rate of variation PVARIB in the tank internal pressure is calculated. If a leak occurs on one side of the jet purge control valve 29 and the purge control valve 30 close to the fuel tank 9, the second rate of variation PVARIB becomes large (see the broken line over the time period E in FIG. 2).

Thereafter, the puff loss valve 22, drain shut valve 26, jet purge control valve 29 and purge control valve 30 are opened, and the bypass valve 24 is closed, to thereby return to the normal purging as indicated at the time period F in FIG. 2.

Figure 3:
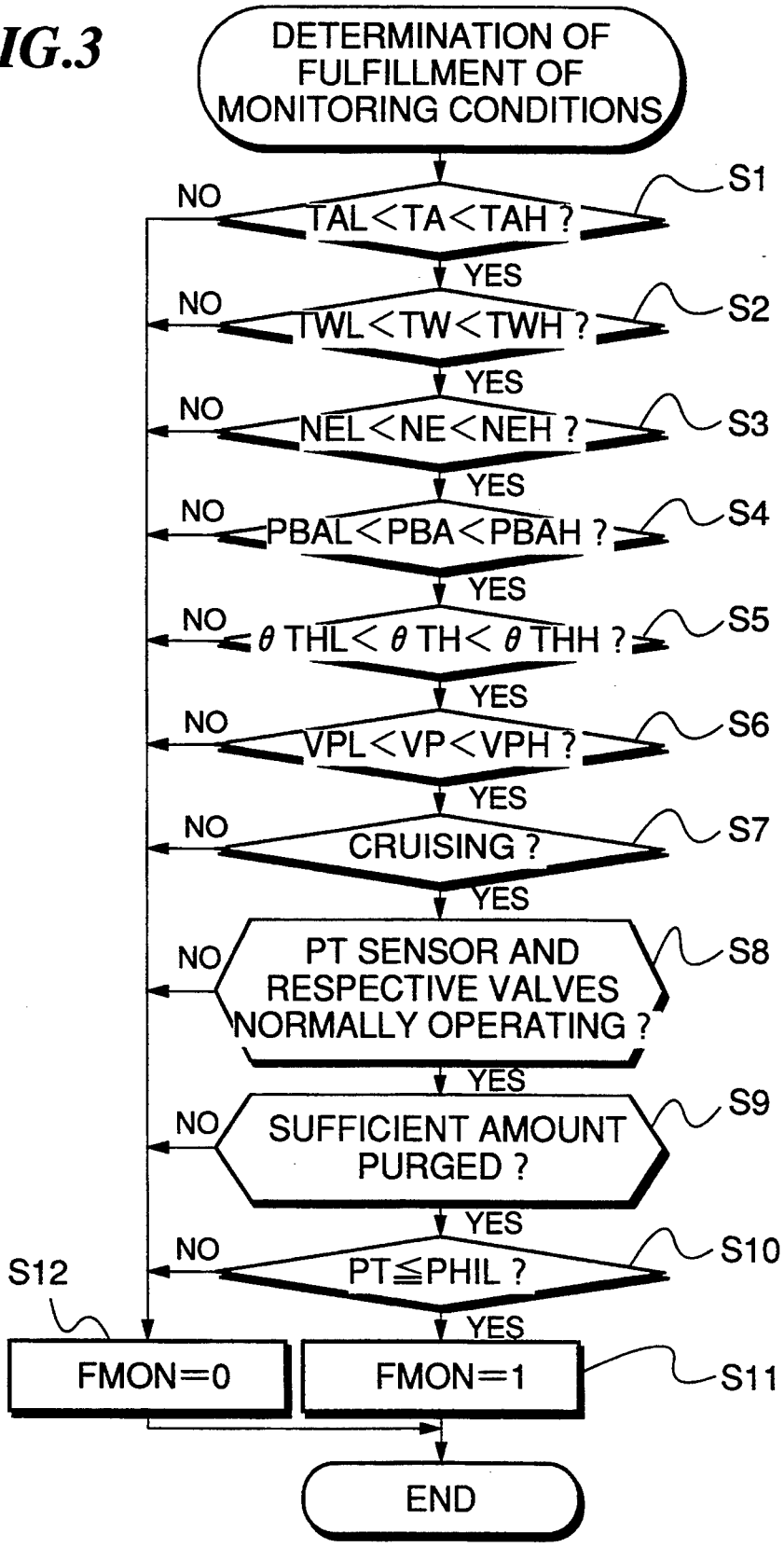
FIG. 3 is a flowchart showing a program for determining whether or not preconditions (abnormality-monitoring conditions) are satisfied.

FIG. 3 shows a routine for determining whether or not the preconditions or abnormality-monitoring conditions are satisfied, which permit to carry out an abnormality diagnosis of the evaporative emission control system 31 in respect of leakage of evaporative fuel. The routine is executed as background processing.

First, at a step S1, it is determined whether or not the intake air temperature TA detected by the TA sensor 14 falls between a predetermined lower limit value (e.g. 50° C.) and a predetermined higher limit value (e.g. 90° C.). If the answer to the question is affirmative (YES), it is determined at a step S2 whether or not the coolant temperature TW detected by the TW sensor 15 falls between a predetermined lower limit value TWL (e.g. 70° C.) and a predetermined higher limit value TWH (e.g. 90° C.). If the answer to the question is affirmative (YES), it is judged that warming-up of the engine 1 has been completed, and then the program proceeds to a step S3.

At the step S3, it is determined whether or not the engine rotational speed NE detected by the NE sensor 16 falls between a predetermined lower limit value NEL (e.g. 2000 rpm) and a predetermined higher limit value NEH (e.g. 4000 rpm). If the answer to the question is affirmative (YES), it is determined at a step S4 whether or not the intake pipe absolute pressure PBA detected by the PBA sensor 13 falls between a predetermined lower limit value PBAL (e.g. −410 mmHg) and a predetermined higher limit value PBAH (e.g. −150 mmHg). If the answer to the question is affirmative (YES), it is determined at a step S5 whether or not the throttle valve opening $\theta$TH detected by the $\theta$TH sensor 4 falls between a predetermined lower limit value $\theta$THL (e.g. 1°) and a predetermined higher limit value $\theta$THH (e.g. 5°). If the answer to the question is affirmative (YES), it is determined at a step S6 whether or not the vehicle speed VP detected by the VP sensor 17 falls between a predetermined lower limit value VPL (e.g. 53 Km/h) and a predetermined higher limit value VPH (e.g. 61 Km/h). If the answer to the question is affirmative (YES), it is judged that the engine 1 has been warmed up and at the same time is in a stable operating condition, so that the program proceeds to a step S7.

At the step S7, it is determined whether or not the vehicle on which the engine 1 is installed is cruising. This determination as to cruising of the vehicle is carried out by determining whether or not the vehicle has continued to travel with a variation in the vehicle speed within a range of ±0.8 Km/sec over two seconds. If the answer to the question is affirmative (YES), it is determined at a step S8 whether or not the PT sensor 29, puff loss valve 22, bypass valve 24, drain shut valve 26, jet purge control valve 29 and purge control valve 30 are operating normally. If the answer to the question is affirmative (YES), it is determined at a step S9 whether or not the purging flow rate of the air-fuel mixture flowing through the purging passage 10 detected by the hot-wire type flowmeter 37 shows a sufficient value. If the answer to the question is affirmative (YES), it is determined at a step S10 whether or not the tank internal pressure PT is lower than a predetermined upper limit value PHIL. If the answer to the question is affirmative (YES), it is judged that the monitoring conditions are satisfied, and therefore a flag FMON is set to "1" at a step S11, followed by terminating the program. On the other hand, if at least one of the answers to the questions at the steps S1 to S10 is negative (NO), it is judged that the monitoring conditions are not satisfied, so that the flag FMON is set to "0" at a step S12, followed by terminating the program.

Figure 4:
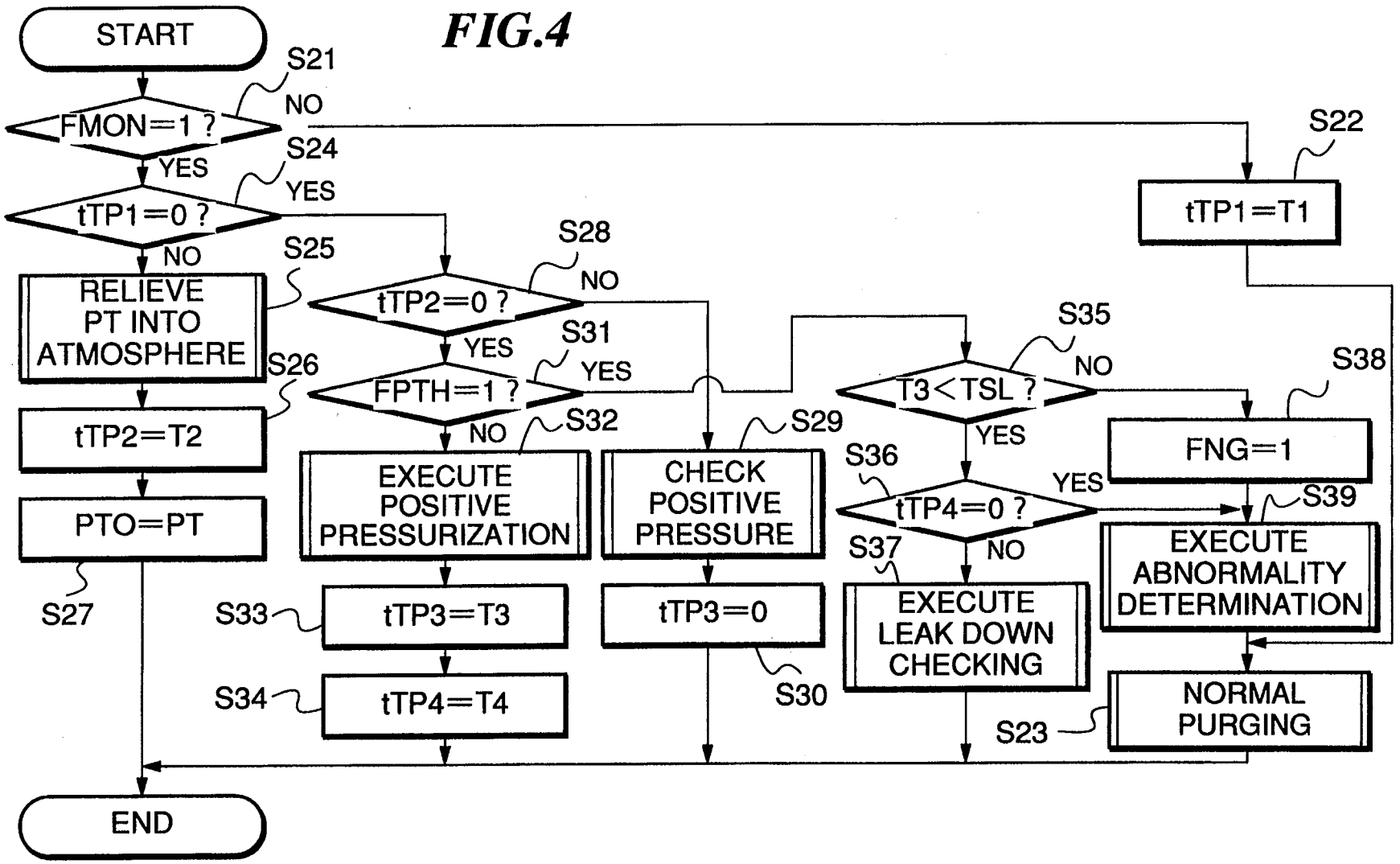
FIG. 4 is a flowchart showing a main program for executing determination of abnormality in an evaporative emission control system appearing in FIG.

FIG. 4 shows a program for executing the abnormality diagnosis of the evaporative emission control system 31, according to the present embodiment. This program is executed as background processing.

First, at a step S21, it is determined whether or not the flag FMON has been set to "1" in the monitoring condition-determining routine described above with reference to FIG. 3. Immediately after the engine 1 has been started, the monitoring conditions are not satisfied, and hence the answer to the question at the step S21 is negative (NO). Therefore, the program proceeds to a step S22, where a first timer tTP1 is set to a predetermined time period T1 and started. The predetermined time period T1 is set to a time period within which the tank internal pressure PT can become stabilized after the tank internal pressure PT is relieved into the atmosphere. Thereafter, the program proceeds to a step S23, where the evaporative emission control system 31 is set to normal purging mode, followed by terminating the program.

If the monitoring conditions are satisfied in a subsequent loop, the flag FMON is set to "1", and then it is determined at a step S24 whether or not the count of the first timer tPT1 has become equal to "0", i.e. whether or not the predetermined time period T1 has elapsed. In the first execution of the step, the answer to the question becomes negative (NO), and therefore the program proceeds to a step S25, where the system 31 is set to open-to-atmosphere mode, followed by setting a second timer tTP2 to a predetermined time period T2 at a step S26. The second timer tTP2 is provided to set a time period required for carrying out positive pressure checking, described hereinafter, and is initially set to the predetermined time period T2. Then, a value PTO of the tank internal pressure PT assumed when the fuel tank 9 is in the open-to-atmosphere mode is set to a present value of the tank internal pressure PT detected by the PT sensor 11 at a step S27, followed by terminating the program. That is, the tank internal pressure value PTO in the open-to-atmosphere mode is renewed to the present value of the PT, followed by terminating the program.

If the predetermined time period T1 has elapsed to make the count value of the first timer tTP1 equal to "0", i.e. if the answer to the question at the step S24 becomes affirmative (YES), the program proceeds to a step S28, where it is determined whether or not the second timer tTP2 has counted up the predetermined time period T2. In the first execution of the step S28, the answer to the question is negative (NO), and therefore the program proceeds to a step S29, where positive pressure checking is executed, and then a third timer tTP3 is set to "0" at a step S30. The third timer tPT3 is provided to measure a time period required for carrying out positive pressurization, described hereinafter, and initially set to "0", followed by terminating the program.

If the predetermined time period T2 has elapsed to make the count value of the second timer tTP2 equal to "0", i.e. if the answer to the question of the step S28 is affirmative (YES), the program proceeds to a step S31, where it is determined whether or not a flag FPTH is set to "1" to indicate that the tank internal pressure PT has reached the predetermined positively pressurized value PTHVL to complete the operation of positive pressurization. In the first execution of the step S31, the answer to the question becomes negative (NO), and therefore positive pressurization is executed at a step S32. Subsequently, at a step S33, the third timer tTP3 is set to a time period T3 which has been required for positive pressurization, i.e. a time period elapsed from the time the third timer tTP3 was initially set to "0" to the time the positive pressurization has been completed. Further, a fourth timer tTP4 for leak down checking is set to a predetermined time period T4 at a step S34, followed by terminating the present routine.

If the flag FPTH is set to "1", i.e. if the answer to the question at the step S31 is affirmative (YES), the program proceeds to a step S35, where it is determined whether or not the time period T3 required for positive pressurization is smaller than a predetermined value TSL. If the answer to the question is affirmative (YES), it is determined at a step S36 whether or not the count of the fourth timer tTP4 is equal to "0". In the first execution of the step S36, the answer to the question is negative (NO), and therefore the program proceeds to a step S37, where leak down checking is executed, followed by terminating the program.

If the time period T3 required for positive pressurization is larger than the predetermined value TSL, i.e. if the answer to the question at the step S35 is negative (NO), a flag FNG is set to "1" at a step S38, and abnormality determination is executed at a step S39. If the count of the fourth timer tPT4 is equal to "0", i.e. if the answer to the question at the step S36 is affirmative (YES), abnormality determination is executed, as well. After execution of the abnormality determination at the step S39, the program returns to the normal purging mode at the step S23, followed by terminating the program.

Next, the open-to-atmosphere processing at the step S24, positive pressure checking at the step S29, positive pressurization at the step S32, leak down checking at the step S37, and abnormality determination at the step S39 will be described in detail with reference to FIGS. 5 to 9, respectively.

(1) Open-to-Atmosphere Processing (Time period B in FIG. 2)

Figure 5:
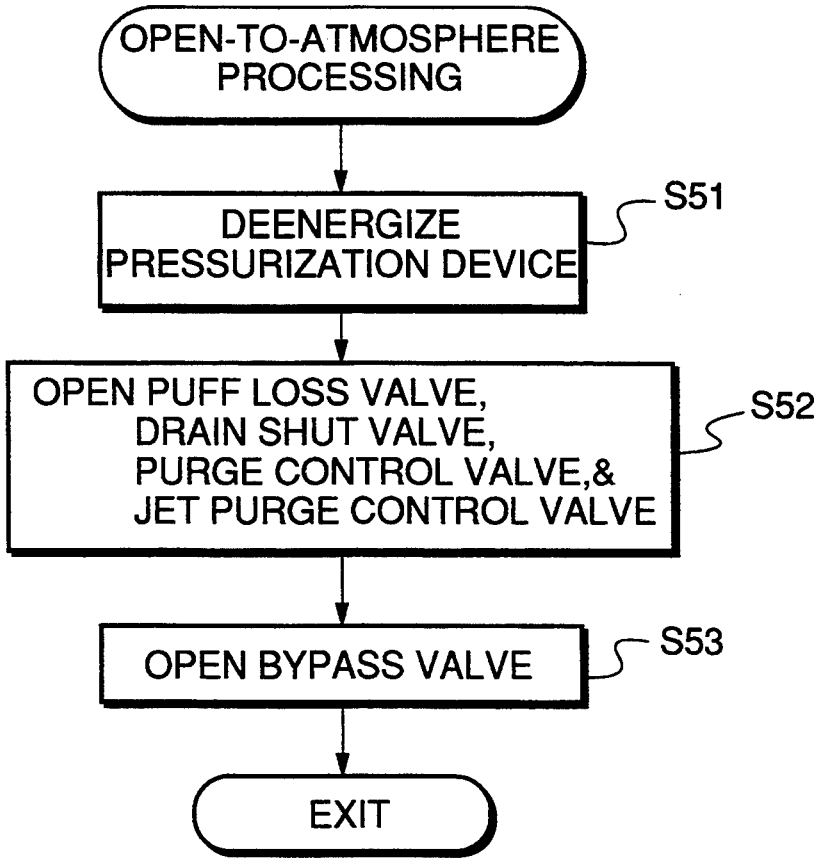
FIG. 5 is a flowchart showing a subroutine for relieving tank internal pressure to the atmosphere.

As shown in FIG. 5, the pressurization device 41 is deenergized at a step S51, and the puff loss valve 22, drain shut valve 26, jet purge control valve 29 and purge control valve 30 are held open at a step S52, while the bypass valve 24 is opened at a step S53. With the device 41 and the valves thus set, the open-to-atmosphere processing is carried out.

(2) Positive Pressure Checking

Figure 6:
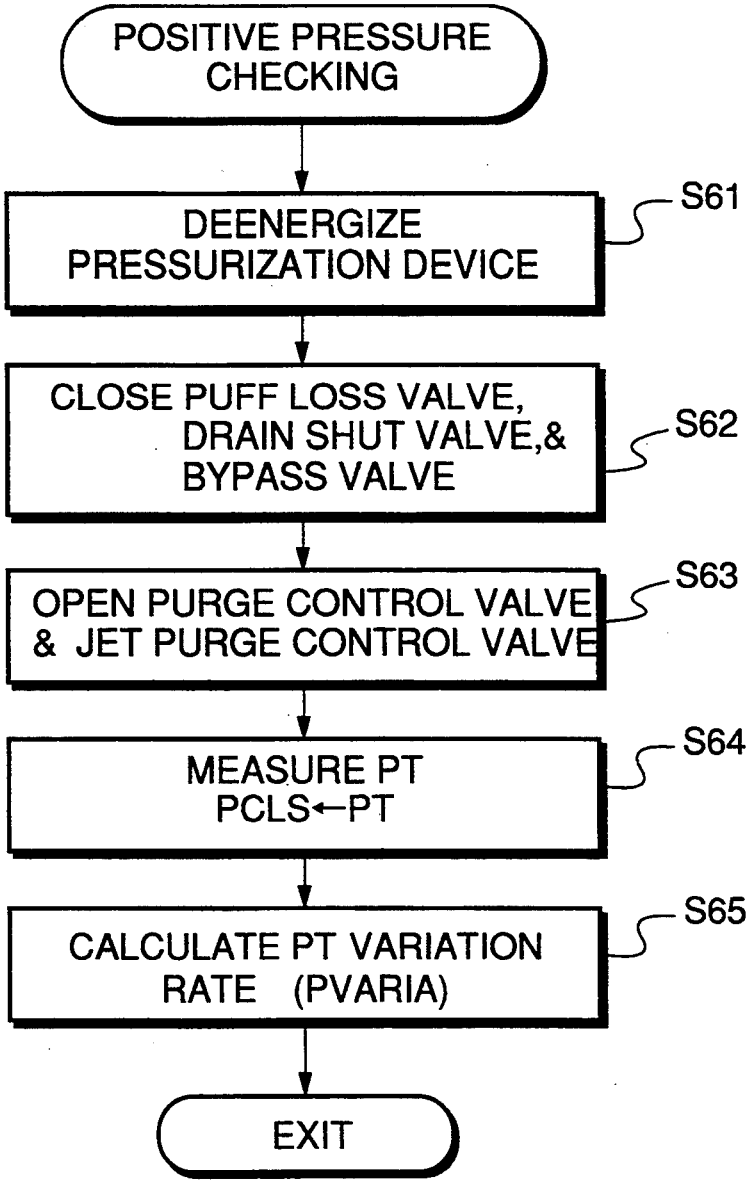
FIG. 6 is a flowchart showing a subroutine for executing positive pressure checking.

As shown in FIG. 6, the pressure device 4 is deenergized at a step S61, and the puff loss valve 22, bypass valve 24 and drain shut valve 26 are closed at a step S62, while the other valves are held in the respective preceding states at a step S63. Then, at a step S64, the tank internal pressure PT is measured to obtain a value PCLS at a step S64, followed by calculating the first rate of variation PVARIA in the tank internal pressure PT, by the use of the following equation (2):

$$PVARIA=(PCLS-PTO)/tTP2 \quad (2)$$

Thus, the PVARIA value represents a rate of variation in the tank internal. pressure PT per unit time during positive pressure checking. In the present embodiment, as the PVARIA value becomes larger, it is determined that evaporative fuel is generated in a larger amount within the fuel tank 9. That is, an amount of evaporative fuel within the fuel tank 9 is detected by the PVARIA value.

(3) Positive Pressurization

Figure 7:
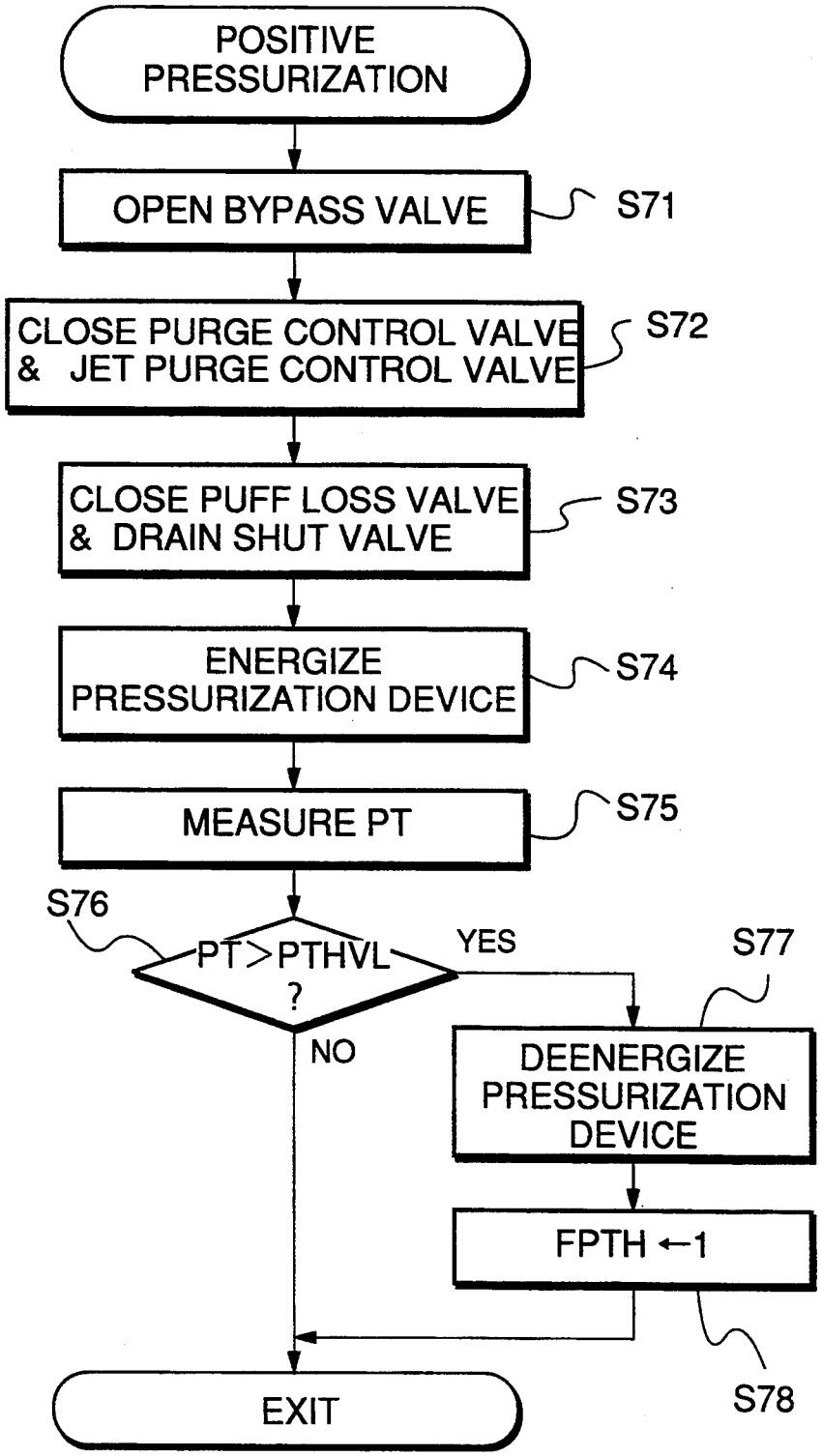
FIG. 7 is a flowchart showing a subroutine for positively pressurizing the evaporative emission control system.

As shown in FIG. 7, the bypass valve 24 is opened at a step S71, the jet purge control valve 29 and the purge control valve 30 are closed at a step S72, and the other valves are held in the respective preceding states at a step S73. Then, the pressurization device 41 is energized at a step S74 to charge air through the canister 25 toward the fuel tank 9, to thereby positively pressurize the interior of the evaporative emission control system 31, while at the same time the tank internal pressure PT is measured at a step S75.

At the following step S76, it is determined whether or not the tank internal pressure PT is larger than the predetermined positively pressurized value PTHVL. If the answer to the question is affirmative (YES), the pressurization device 41 is turned off at a step S77, and then the flag FPTH is set to "1" at a step S78, followed by terminating the program. On the other hand, if the answer to the question at the step S76 is negative (NO), the program skips over the steps S77 and S78, followed by terminating the program.

(4) Leak Down Checking

Figure 8:
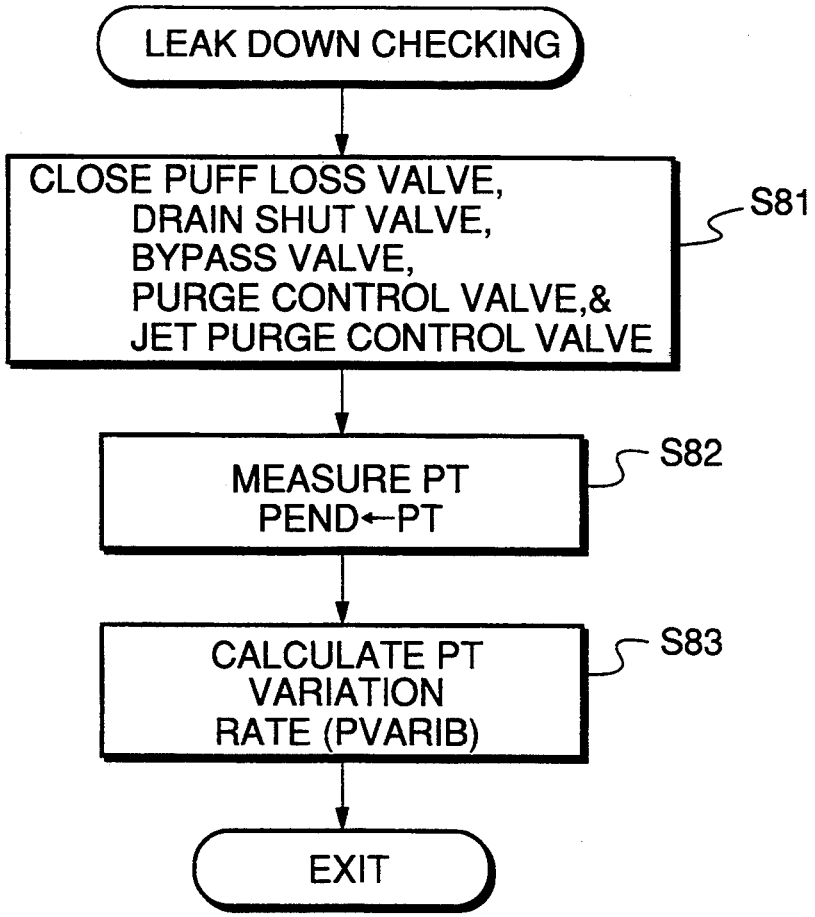
FIG. 8 is a flowchart showing a subroutine for executing leak down checking.

As shown in FIG. 8, all the valves are held in the respective preceding states at a step S81, and the tank internal pressure PEND is measured at a step S82. Then, the second rate of variation PVARIB is calculated by the use of the following equation (3):

$$PVARIB=(PEND-PTHVL)/tTP4 \quad (3)$$

Thus, the PVARIB value represents a rate of variation in the tank internal pressure PT per unit time during leak down checking.

(5) Abnormality Determination

Figure 9:
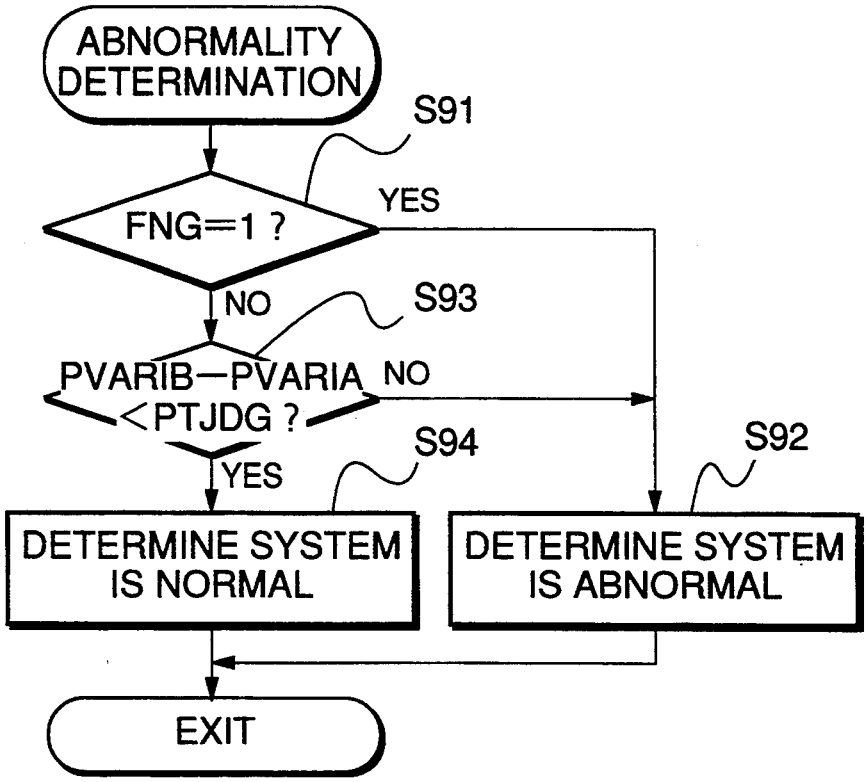
FIG. 9 is a flowchart showing a subroutine for executing determination of abnormality.

As shown in FIG. 9, at a step S91, it is determined whether or not the flag FNG, which is set to "1" when the time period T3 required for executing the aforestated positive pressurization is larger than the predetermined value TSL, is set to "1", and if the answer to the question is affirmative (YES), it is determined at a step S92 that the evaporative emission control system 31 suffers from leakage, requiring a long time period for positive pressurization, and therefore the system is determined to be abnormal, followed by terminating the program. On the other hand, if the answer to the question at the step S91 is negative (NO), the program proceeds to a step S93, where it is determined whether or not a difference obtained by subtracting the PVARIA value from the PVARIB value is smaller than a predetermined value PTJDG. If the answer to the question is affirmative (YES), it is determined at a step S94 that the system is normal, followed by terminating the program. On the other hand, if the difference is larger than the predetermined value PTJDG (indicated by the broken line over the time period E in FIG. 2), it is determined at the step S92 that the amount of leakage is large, whereby the system is determined to be abnormal.

As described above, according to the present embodiment, the difference obtained by subtracting the PVARIA value from the PVARIB value is compared with the predetermined value PTJDG, and a determination as to leakage is carried out based on the comparison result, i.e. in a manner reflecting the state of generation of evaporative fuel within the fuel tank 9. More specifically, the subtraction of the PVARIA value, which represents the amount or rate of generation of evaporative fuel, from the PVARIB value enables to carry out a leakage diagnosis in a manner reflecting an amount of generation of evaporative fuel, resulting in more accurate abnormality determination.

In the present embodiment, it may be determined that when the tank internal pressure PT cannot be increased to the predetermined value PTHVL, a leak occurs from the evaporative emission control system 31, to thereby judge that the system 31 is abnormal.

When the PVARIA value is larger than a predetermined value, which means that an extremely large amount of evaporative fuel has been generated, it may be determined that an accurate leakage diagnosis cannot be carried out, and then execution of the leakage diagnosis may be inhibited.

Although in the embodiment described above, the amount of generation of evaporative fuel is detected based on the PVARIA value, it may be alternatively estimated from a Reid vapor pressure (RVP) value of gasoline used in the engine and the temperature of fuel.

The PT sensor 11 may be mounted in the canister 25 or in the charging passage 20, in place of in the fuel tank 9. In such an alternative case, however, it is required to compensate the output from the PT sensor for a pressure loss in the passage 20.

The pressurization device 41 may be provided directly in the fuel tank 9.

What is claimed is:

1. An evaporative fuel-processing system for an internal combustion engine having an intake passage, comprising:

an evaporative emission control system having a fuel tank, a canister for adsorbing evaporative fuel generated within the fuel tank, a first passage connected to said canister for opening an interior of said canister into the atmosphere, a second passage extending from said canister to said intake passage, a purge control valve arranged across said second passage, and a third passage connecting between said fuel tank and said canister, shut-off valve means arranged across said third valve, open-to-atmosphere means for opening the interior of said evaporative emission control system into the atmosphere by opening said purge control valve, an open-to-atmosphere control valve, and said shut-off valve means, and closure means for closing said fuel tank by closing said open-to-atmosphere control valve and said shut-off valve means after the interior of said evaporative emission control system is opened into the atmosphere;

pressurization means for pressurizing an interior of said evaporative emission control system;

pressure-detecting means for detecting pressure within said fuel tank;

said open-to-atmosphere control valve arranged across said first passage;

positive pressure-setting means for closing said purge control valve and said open-to-atmosphere control valve, and for actuating said pressurization means to bring said evaporative emission control system into positively pressurized state, after said purge control valve and said open-to-atmosphere control valve are closed;

evaporative fuel amount-detecting means for detecting an amount of evaporative fuel generated in said fuel tank from a rate of variation in the pressure within said fuel tank detected by said pressure-detecting means after said fuel tank is closed; and abnormality-determining means for determining whether there is a leakage from said evaporative emission control system, based on a rate of variation in the pressure within said evaporative emission control system detected by said pressure-detecting means after said evaporative emission control system is brought into said positively pressurized state, and a reference value determined based on the amount of evaporative fuel detected by said evaporative fuel amount-detecting means.

2. An evaporative fuel-processing system as claimed in claim 1, including abnormality determination-inhibiting means for inhibiting operation of said abnormality-determining means when the amount of evaporative fuel detected by said evaporative fuel amount-detecting means is larger than a predetermined value.

3. An evaporative fuel-processing system as claimed in claim 1, including correcting means for correcting the rate of variation in the pressure within said evaporative emission control system detected by said pressure-detecting means after said evaporative emission control system is brought into said positively pressurized state, based on the amount of evaporative fuel detected by said evaporative fuel amount-detecting means, and wherein said abnormality-determining means determines that there is a leakage from said evaporative emission control system when the corrected rate of variation in the pressure is larger than a reference value.

* * * * *